United States Patent [19]

Till et al.

[11] Patent Number: 4,501,623

[45] Date of Patent: Feb. 26, 1985

[54] PROCESS FOR CLEANING A BARREL

[76] Inventors: Heinz Till, Fischbacher Weg 28; Volker Till, Eichendorffstrasse 17, both of D-6238 Hofheim, Fed. Rep. of Germany

[21] Appl. No.: 432,921

[22] PCT Filed: Feb. 15, 1982

[86] PCT No.: PCT/DE82/00030

§ 371 Date: Sep. 27, 1982

§ 102(e) Date: Sep. 27, 1982

[87] PCT Pub. No.: WO82/02705

PCT Pub. Date: Aug. 19, 1982

[30] Foreign Application Priority Data

Feb. 14, 1981 [DE] Fed. Rep. of Germany ..... 3105411
Mar. 30, 1981 [DE] Fed. Rep. of Germany ..... 3112510
Apr. 9, 1981 [DE] Fed. Rep. of Germany ..... 3114284

[51] Int. Cl.[3] ..... B65B 3/04

[52] U.S. Cl. ..... 134/22.18; 137/12.5; 141/89

[58] Field of Search ..... 141/89–92, 141/54; 134/102, 166 R, 171, 22.18; 137/12.5

[56] References Cited

U.S. PATENT DOCUMENTS 3,166,106 1/1965 Reeve et al. ..... 141/91
3,564,584 2/1971 Ruddick ..... 134/166 R

*Primary Examiner*—Stephen Marcus
*Assistant Examiner*—Mark Thronson
*Attorney, Agent, or Firm*—Goodman & Teitelbaum

[57] ABSTRACT

An appliance for the handling of barrels which have in the region of the barrel mantle a bung plate with a bung opening, is to be reusable and is to permit an intensive automatic handling of such barrels. This appliance has for this purpose a casing forming a first tight seat, a riser tube connected with the casing, extending into the barrel interior to near the wall of the barrel mantle lying opposite the bung opening, forming a second tight seat, as well as an annular valve body with which the pusher device in a first opening position frees an inner flow path between a pusher interior space and the riser tube interior space and an outer flow path separate from this between the pusher exterior space and spray openings of comparatively small cross section distributed in the casing, directed upon the inner surfaces of the barrel, and in a second opening position as outer flow path instead of this or in addition between the pusher exterior space and filling openings of comparatively large cross section provided in the casing.

5 Claims, 9 Drawing Figures

15
3
2
10
7
5
46
44
27
22
45
21
40
33
43
12
6
34
35
1
18
19
24
9
38
26
30
11
32
8
31

15
3
2
7
17
D
29
29
21
5
56
40
22
43
45
B
54
12
50'
34
57
49
58'
59
11
8
14
24
19
26
28
1
A
53'
C

PROCESS FOR CLEANING A BARREL

The invention relates to an appliance for cleaning filling and/or tapping of barrels, especially to be used in breweries, with a bung plate presenting a bung opening, a process for cleaning a barrel with use of such an appliance and a barrel equipped with such an appliance. When in the present context an "appliance" is spoken of, there is meant by it the appliance of a barrel and also this appliance in cooperation with a treatment head or a tapping appliance as functional unit.

For the filling of beer in barrels the breweries use predominantly barrels with roll corrugations, which barrels are provided in the zone of the roll corrugations on the mantle side with a bung plate, in the bung opening of which provided with a thread there is screwed a bung screw. Such barrels are ordinarily cleaned by introduction of a nozzle through the opened bunghole into the interior of the barrel. The inside of the barrel is then inspected for foreign bodies and transported to a filling appliance. There it is filled by an isobarometric filling device and thereupon closed again with the bung screw. All these processes, such as delivery onto the cleaning device, inspection after the cleaning, reading on the filling devices, filling and closing as well as the subsequent storage are carried out largely manually, whereby the entire cleaning and filling process is affected with high wage costs. Because of the long period of opening of the barrel there is present, furthermore, the danger that dirt and foreign bodies will be present in the barrel, since this is opened for emptying outside the brewery. Moreover, in the inspection the bunghole plugs knocked into the interior of the barrel have to be removed.

According to German utility model No. 79 18 135 there is known a beer barrel in which in the barrel mantle there must be present a bunghole and in the bottom of the barrel a tap hole. In the bunghole plug there is provided a beer outlet valve constructed as nonreturn valve with plug coupling receiving device and in the tap hole there is provided a pressure gas inlet valve likewise as a nonreturn valve and provided with plug coupling receiving device. Thereby there is to be made possible without change of the barrels in use, however, exclusively a complete emptying with a topping device without riser tube to be connected rapidly and easily and to be cleaned without problems. The problem of the inside cleaning and filling of the barrel is not addressed here. For the emptying, the expenditure in manual handling is not satisfactorily reduced, since both at the bunghole and also at the tap hole the plug couplings have to be applied by hand.

German unexamined patent specification No. OS 27 10 961 shows and describes merely a filling installation for barrels, in which, to be sure, the manual operations otherwise required are largely to be replaced by mechanical devices. This installation concerns itself, however, only with the correct positional orientation of the barrel in the filling operation, so that the filling device can plunge surely into the upward-facing bunghole.

From German utility model No. GM 73 29 532 there is known a swinging spray head for container cleaning, which plunges into the upward-facing bunghole. Here there is to be solved the problem of acting upon the entire inner surface of the container by the swinging movement of the spray head periodically with the cleaning fluid jets. For this the expensive manual operations already mentioned above are not to be avoided and just as before there is present the problem of infection of the interior of the barrel, since here, too, the barrel is opened outside the breweries for the emptying.

There are already on the market and in use at various breweries cylindrical barrels, so-called kegs, which have on one face side a valve installed in the riser tube, through which the barrel has to be opened only for a short time still in the cleaning, filling and emptying by operation of the valve, for example by emplacement on a treatment head or the tapping appliance, but is otherwise automatically closed. Furthermore, such kegs can be handled fully automatically in the brewery.

The barrel stock of a brewery, which in the Federal Republic of Germany would presumably come of several tens of millions, presents a considerable value, in many faces indeed a large part of the assets of the brewery. It is hardly possible, therefore, to put the barrels altogether out of service and to replace them by kegs. It is at present also disadvantageous to satisfy the replacement requirement in barrels by the purchase of the more advantageous kegs and to keep the barrels on hand further in operation, since then two cleaning and filling systems would have to be present next to one another in a brewery.

The problem of the present invention is to propose an appliance for barrels which permits the automated cleaning, filling and/or tapping of the barrels, especially also with use of the machines or appliances to be used for the kegs.

This problem is solved according to the invention by a casing fixed in the bung opening, forming a first (radially outer) tight seat, a riser tube extending into the interior of the barrel to near the wall of the barrel mantle lying opposite the bung opening, forming a second (radially inner) tight seat, and by an annular valve body-liftable in the emplacement on a treatment head or a tapping appliance a pusher device of the treatment head the tapping appliance against action of a spring from the first and the second tight seat, which valve body in cooperation with the pusher device in a first opening position frees an inner flow path between a (central) pusher inner space and the riser tube inner space and an outer flow path separated from this between an (annular) pusher outer space and spray openings of comparative small diameter directed upon the inner surface of the barrel and in a second opening position as outer flow path instead of this or in addition frees as outer flow path openings of comparatively large cross section between the pusher outer space and filling openings provided in the casing.

The appliance according to the invention makes use of a riser tube as the valve that is installed on face side in kegs. While in the cylindrical barrels the cleaning effect is achieved by the means that the cleaning fluid is directed predominantly through the riser tube upon the oppositely lying face side of the inner surface of the cylindrical barrel, in the case of the appliance of the invention the supplying of the cleaning fluid occurs principally through the outer flow path, namely the spray openings. Hereby it is possible to do justice to the special problem that, despite the belly-side installation of the appliance of the invention and the resulting unsymmetrical position with respect to the form of the interior of the barrel there is achieved a sufficiently uniform cleaning of all the inner surfaces of the barrel. Through the mechanical emplacing of the barrel with an appliance according to the invention on a treatment head, there are automatically opened the required flow paths for the cleaning fluid. The filling of a barrel equipped with the appliance of the invention occurs in like manner over the outer flow path, while, however, the valve body is in a second opening position. In this second opening position of the valve body at any rate filling openings of comparatively large cross section are freed. During the cleaning, therefore, only the spray openings of comparative small cross section go into operation. Hereby, with sufficiently low expenditure of cleaning fluid it is possible to obtain adequately powerful spray jets, which lead to the intensive cleaning of the inner surface of the barrel. For the filling, in contrast, there are also available the comparatively large filling opening. While the cleaning occurs preferably with bung opening turned downward, so that the used cleaning fluid flows off directly over the outer flow path, in the filling and emptying the bung opening can lie both above and also below. In the filling from above the beverage fluid is supplied to the inner flow path, therefore the riser tube, while the gas to be displaced, for example tensioning gas, can escape over the outer flow path, therefore, in particular, the filling openings lying open. In the filling from underneath the beverage fluid feed occurs through the outer flow path, while the gas, for example tensioning gas, escapes over the riser tube, therefore the inner flow path. In the tapping, either the beverage fluid can be dispensed, in the case of downward-turned bung opening, over the outer flow path, while the riser tube opening over the inner flow path provides for the pressure compensation. In the case of bunghole facing upward a pressure medium source can be connected to the outer flow path and the beverage fluid expelled over the riser tube.

The pusher device contains according to one form of execution of the invention two coaxial sleeves adjustable axially to one another, of which the inner sleeve can come to lie with sealing effect on face side against the valve body and the outer sleeve with sealing effect on face side against the casing or the bung plate. Thereby, in the emplacement of a barrel with an appliance according to the invention necessarily the two separate flow paths are formed, while through the axial shifting of the inner sleeve the valve body can be shifted axially out of its closed position in which it lies against the first and second tight seat, into the first and second opening position.

The riser tube presents preferably above the second tight seat passage openings connecting the riser tube inner space and the surrounding casing inner space, traversable by the valve body. Thereby, in the lifting of the valve body out of the starting sealing position necessarily the inner flow path from the inner sleeve of the pusher device into the riser tube inner space is opened, and, indeed, regardless of whether the valve body is in the first or second opening position, in which either only the spray openings lie open (first opening position) or the filling openings or both (second opening position) for the media passage.

Preferably the valve body has sealing segments facing radially outward distributed in angular spacing in correspondence to the arrangement of the filling openings over the circumference, which segments in the first opening position of the valve body cover over the filling openings with sealing effect and in the second opening position free them. Hereby it is achieved that regardless over whether the valve body is in the first or second opening position, the passage of a medium is possible from the pusher outer space through the spray openings. The media, namely, can pass axially between the sealing segments.

If the valve body is conducted with sealing effect sliding on the outer surface of the riser tube has an outer cross section diminishing with respect to the inner cross section of the casing and is conducted on the outside over the sealing segments on the inner surface of the casing, there is prevented a tiling of the valve body abutting on the restoring spring.

Preferably there are provided lower spray openings in the immediate vicinity of the barrel wall, preferably in a thickened wall zone of the casing in each case. These spray openings serve, on the one hand, the end that also the inner surface of the barrel wall in the immediate vicinity of the appliance is adequately sprayed with cleaning fluid. On the other hand, these spray openings serve for the complete lead-off of cleaning fluid from the interior of the barrel after a cleaning operation.

The thickened wall zones may preferably be distributed over the inner circumference of the casing to form between them free spaces which, according to angular position and width, serve for the guiding reception of the sealing segments at any rate one, preferably the lower, part of the axial movement path of the valve body. Thereby there is ensured a further guidance of the valve body and through prevention of any twisting of the valve body it is made certain that the sealing segments dependably seal the filling openings in the first opening position of the valve body.

In another development of the invention the pusher device has three coaxial sleeves axially shiftable with respect to one another, of which the innermost sleeve can come to lie with sealing effect on face side against the valve body, the middle sleeve against a third tight seat of the casing axially behind the filling openings and the outermost sleeve on face side with sealing effect against the casing or the bung plate. Hereby three separate flow paths are created, and, namely, an innermost flow path from the interior of the innermost sleeve into the riser tube inner space, in the filling an outer flow path from the annular space between the innermost sleeve and the outermost sleeve into the filling openings of the casing, the valve body being in a second opening position in sealing engagement on the outer surface of the riser tube and the third tight seat of the casing, and a middle flow path from the annular space between innermost sleeve and middle sleeve to the upper spray openings of the casing, the middle sleeve being in sealing engagement on the third tight seat of the casing, while the valve body is lifted off from this third tight seat into a first opening position by means of the innermost sleeve against the action of the restoring spring.

The spray openings are present, for example, in cap section preferably detachably joined with the approximately cylindrical main body of the casing. They are thereby in a favorable position with respect to the inner surfaces of the barrel walls. The detachable mounting of the cap section on the main body of the casing has the advantage of simpler assembling of the appliance.

The riser tube itself is preferably connected with the cap section, and is held, if need be, over the cap section coaxially in the casing.

The spring for the resetting of the valve body abuts, in an advantageous further development of the invention, on the cap section or on a counter-bearing borne by this. Thereby, the spring, on removal of the cap section, can be simply inserted in the casing.

The casing is advantageously screwed with a casing head into the possibly enlarged bung opening provided with a thread, and, if need be, with interposition of an axially or radially acting seal. Thereby, there is given a simple assembling and disassembling.

The casing head may have a face-side hollow space for the reception of a tapping appliance. The appliance of the invention is thereby suited also for use with conventional tapping accessories already on hand.

In a further development of the thought of the invention the riser tube has on face side a nut untwistably joined in the hollow space of the casing head with counter ledge for the valve body bias-tensioned by the spring. With the aid of the nut, the entire one-part casing, on which also the riser tube lies fast, can be screwed into the bung opening. This nut forms there an outer stop for the valve body, so that a simple assembling is possible also of the valve body with the appertaining restoring spring in the casing.

The invention relates also to a process for the cleaning of a barrel with use of an appliance according to the invention. This cleaning process proceeds according to the invention in such a way that in the first opening position of the valve body the cleaning fluid is fed preferably predominantly to the outer flow path or preferably predominantly to the inner flow path during predetermined, possibly alternating periods of time, preferably in pulsations and in each case in time periods following thereupon the cleaning fluid accumulated in the interior of the barrel is expelled, for example, by action of gas pressure on it of the inner flow path out of the inner space of the barrel. Here, therefore, the barrel is present with appliance turned downward.

There, for example during the period of time during which cleaning fluid is fed to the outer flow path, it is possible to supply cleaning fluid also to the inner flow path.

The pulsating feed of the cleaning fluid has the advantage that with relatively slight consumption of cleaning fluid relatively strong jets strike against the inner wall surfaces of the barrel at brief intervals and thus there is achieved the cleaning effect. If, for example, cleaning fluid is supplied also to the riser tube, and not only to the spray openings of the casing, then the surface of the barrel wall lying opposite the riser tube and the entire space between the roll corrugations is faultlessly cleaned as well.

The invention is also directed to a barrel to be used in breweries with only one bunghole, which is arranged in a bung plate provided in the zone of the barrel mantle, which is distinguished by an appliance, for example the one characterized in detail above, which connects the barrel interior with the barrel exterior only during the emplacement on a treatment head or of a tapping appliance for the purpose of cleaning and/or filling or tapping, without the barrel interior coming in contact with the atmosphere over a relatively long period of time, but otherwise holding the barrel interior closed with sealing effect.

The invention relates also to an appliance.

It presents a further improvement of the appliance already proposed.

With the features of the invention, it is achieved that the valve body during its movement is additionally guided by the inner sleeve and a tilting and thereby sticking of the valve body is perfectly avoided.

With the measure of the three sleeves of the pusher device, the innermost sleeve can be dispensed with. In though, this solution lies in that in the pusher arrangement hitherto consisting of three sleeves, the innermost sleeve is collapsed with the middle sleeve in such a way that the middle sleeve of hitherto takes over both the sealing function of the outer flow path through the comparatively large filling openings of the two inner flow paths through the comparatively small spray openings of the casing and the passage openings of the riser tube as well as the shifting of the valve body from the closing position into the two opening positions. From the arrangement of hitherto this form of execution differs in that in the cleaning a common stream of cleaning fluid is supplied to the interior of the casing and to the interior of the riser tube. It has proved, namely, that under certain conditions a separate feed of cleaning fluid to these inner spaces is not required.

According to the execution of the invention, there is achieved the further considerable advantage that the conical inner thread already present of the bung plate is utilized for the fixing of the casing head on the bung plate. For the fixing in place of the appliance according to the invention, as it was proposed with the main application, no special thread has to be provided. The interlayer of the plastic layer brings about there a faultless sealing of the casing head against the bung plate and a complete insulation of the metallic materials of the casing head and of the bung plate. The former consists, namely, preferably of steel, while the latter ordinarily consists of aluminum. A direct contact of these two metals in the presence of beverages, for example beer, containing carbon dioxide leads, however, to considerable corrosion. This plastic interlayer can be provided in various manners. It can consists, for example, in a coating of the outer thread of the casing head. It may, however, consist also, for example, in a plastic collar, which only on turning of the casing head into the conical thread of the bung plate embeds itself into the thread courses. There, under some circumstances, the casing head does not need to present any outside thread, if the plastic collar has adequate strength and on turning of the casing head into the thread of the bung plate, the plastic collar is deformed on its outer surface in correspondence to the thread of the bung plate. For example, there can be achieved also a surface pressing of the increasing axially inward, as either the wall thickness of the plastic collar or of the plastic coating increases from axially outside toward the inside, or the casing head tapers slightly more weakly outside than the inner thread of the bung plate.

If the plastic layer is constructed as a separate plastic collar, then it is expedient to fix it to the casing head The inner sealing bulge there takes over the function of an additional seal bounding directly on the wall inner surface of the barrel mantle.

In the bayonet connections of hitherto between for example, a tapping appliance and a barrel appliance cams of the barrel appliance of relatively short circumferential length grip into correspondingly small-dimensioned recesses or free spaces of the bayonet counterpart on the treatment head or the tapping appliance, which also presents the inner guide surfaces for the bayonet cams of the barrel appliance.

With the proposal of the invention, there is proposed precisely a reverse solution; i.e., the bayonet cams of relatively short circumferential length are on the treatment head or the tapping appliance, while on the casing head now there are provided the free spaces of relatively short circumferential length with the allocated guide surfaces for the bayonet cams. Thereby there is created a casing head which is suited not only for use with the cylindrical barrels, the so-called kegs, introduced in the meantime, but especially also for the barrels which are ordinarily rolled. By reason of the special formation of the casing head, despite this relatively rough treatment, namely, there can no longer occur a disadvantageous deformation of the otherwise usual cams.

Further aims, features, advantages and possibilities of use of the present invention are yielded from the following description of an example of execution with the aid of the appended drawing. There, all the features described and/or pictorially represented by themselves or in any reasonable combination form the object of the present invention.

FIG. 1 shows schematically in section an appliance presenting the invention according to one form of execution, in which to the left of the center line the valve body is shown in the starting closed position, to the right (in solid lines) in the second opening position and (indicated in broken lines) in the first opening position;

FIG. *2a* shows an alternative form of execution of an appliance presenting the invention, in which to the left of the center line the valve body is shown in the starting closed position and to the right of the center line the valve body is illustrated in the second opening position;

FIG. *2b* shows a cut-out of the appliance according to FIG. *2a*, in which the valve body is in a second opening position;

Figure 1:
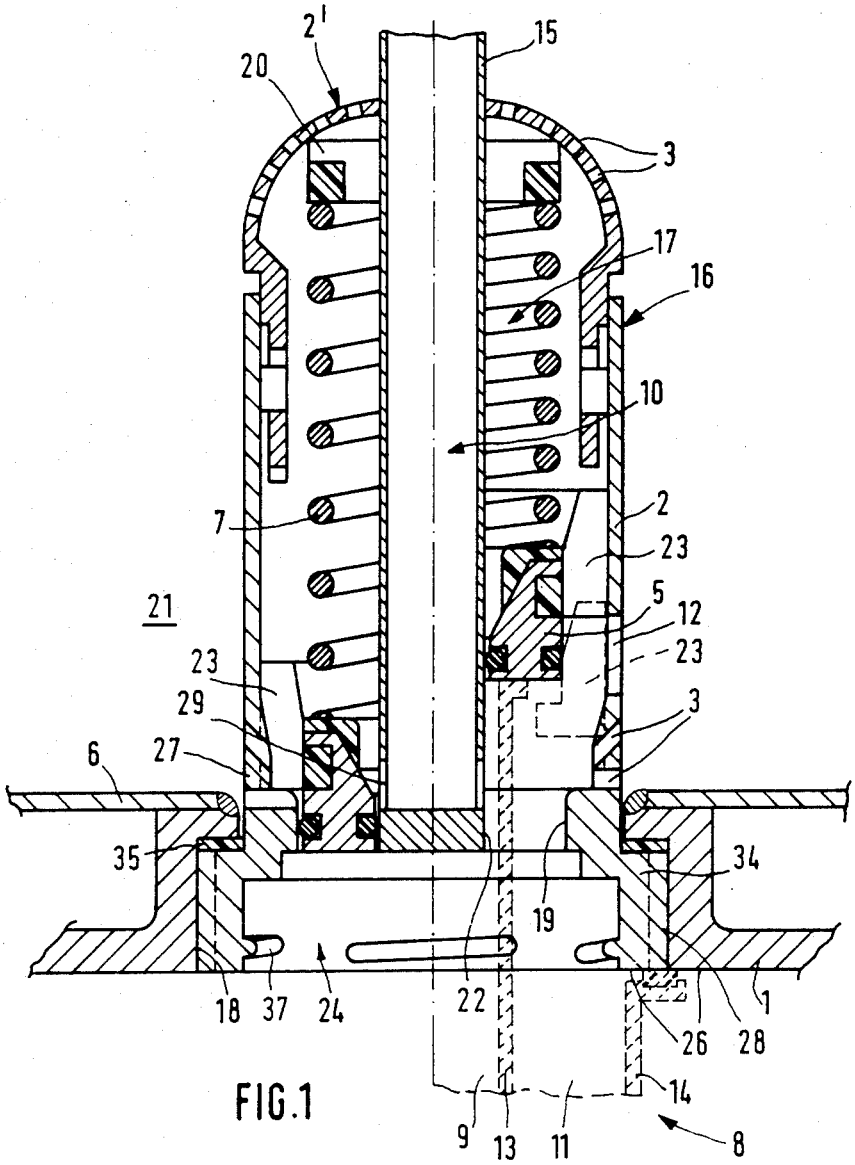

FIGS. *5a* and *5b* show a section through another development of the appliance according to the invention with two sleeves of the pusher device; and FIGS. *6a* and *6b* show plan views of two different casing heads with special bayonet lock elements.

The bung plate 1 presents according to the invention a bung opening 18 provided with inside thread. Into the thread there is screwed an approximately cylindrical casing 2 with a casing head 34 and therewith fastened over the thread connection 28 to the bung plate 1. Here, the casing head 34, enlarged with respect to the cross section of the rest of the casing 2, with interposition of an axial seal 35, comes to lie against outward-facing ledges of the bung opening 18. The casing 2 carries on its barrel-inside end, releasable over bayonet lock 16, a cap section 2', in which there are spray openings 3 of comparatively small cross section pointing in the direction of the inner surfaces of the barrel walls. On the cap section 2' a riser tube 15 is held coaxially in the casing 2. The riser tube 15 extends into the vicinity of the oppositely lying wall of the barrel into the barrel interior 21. Downward the riser tube 15 extends to the casing head 34. There, the riser tube 15 forms, opposite a first tight seat 19 surrounding the casing 2, a surrounding secbnd tight seat 22 for a substantially annular valve body 5. In the direction of the interior of the barrel, immediately behind the second tight seat 22 there are present in the wall of the riser tube 15 passage openings 29 from the casing interior 17 into the riser tube interior 10. Immediately in the vicinity of the barrel mantle 6 there are present in the casing 2 further spray openings 3 of comparatively small cross section, which can in part be set obliquely in the direction of the inner surface of the barrel wall. A part of these spray openings 3 lies at any rate immediately bordering on the inner surface of the barrel wall 6, so that liquid can flow from the barrel interior 21 largely free of residue into the casing interior 17. Somewhat above the lower spray openings 3 there are present in the casing 2, distributed over the circumference, filling openings 12 of relatively large cross section. It is learned from the drawing that the lower spray openings 3 are accommodated in thickened wall zones 27 of the casing 2. The annular valve body 5 encloses the riser tube 15 and is guided by means of a sealing ring, with which it lies also on the second tight seat 22 in the starting closed position, axially on the outer surface of the riser tube 15. There the valve body 5 abuts over a pressure spring 7 on a counter-bearing 20, which is fixed either on the cap section 2' or the riser tube 15. The outside diameter of the valve body 5 is smaller than the inside diameter of the casing 2. The distance is bridged by sealing segments 23 distributed in angular spacing on the circumference of the valve body 5. The angular arrangement of the sealing segments 23 corresponds to the angular distribution of the filling openings 12 in the casing 2. The height and width of the sealing segments 23 exceeds, further, the corresponding dimensions of the filling openings 12. Over the sealing segments 23 the valve body 5, therefore, is also guided axially on the inner surface of the casing 2. In the starting closed position of the valve body 5, represented to the left of the center line, this lies over an outer sealing ring on the first tight seat 19 of the casing 2, while the sealing segments 23 are provided in open spaces between reinforced wall zones 27 distributed over the circumference of the casing 2. These open spaces serve for the guidance of the sealing segments 23, so that the valve body 5 cannot turn about its axis and the sealing segments 23 always lie aligned to the filling openings 12. On emplacement of a barrel with the appliance according to the invention these cooperate with a pusher device 8 of the treatment head. The pusher device 8 consists essentially of an inner sleeve 13 and an outer sleeve 14, which, for example, are held in the treatment head springly and adjustable axially independently of one another. The inner sleeve 13 comes to lie with face side against the valve body 5 with sealing effect, while the outer sleeve 14 comes to lie with face side sealing effect against the face surface 26 of the bung plate 1 or of the casing head 34. Thereby the two concentric sleeves 13 and 14 form an inner channel through the pusher interior 9 and an outer annular channel through the pusher exterior space 11. The sleeves 13 and 14 are axially adjustable to one another. The inner sleeve 13, as illustrated to the right of the center line, can, therefore, be slid axially further into the casing interior 17. The sleeve 13 then presses the valve body 5 against the action of the spring 7 into a first opening position (shown only in broken lines with the aid of the sealing segments 23 and into a second opening position (represented in solid lines). In both opening positions, as can be seen, an inner flow path is freed from the pusher interior 9 through the perforations 29 into the riser tube interior 10. In the first opening position of the valve body 5 the sealing segments 23 seal off the filling openings 12, so that only an outer flow path is freed from the pusher exterior space 11 into the casing interior space 17 and from there over the spray openings 3. In this first opening position the cleaning process occurs, as over the pusher exterior space 11 and, if need be, also over the pusher interior space 9 cleaning fluid is sprayed through the spray openings 3 and possibly also through the riser tube 15 onto the inner surface of the barrel wall 6. The cleaning fluid feed can take place in pulsations and periodically, in order to achieve the desired cleaning effect. Cleaning fluid collected in the barrel interior space 21 can flow off over the lower spray openings 3 in intermediately lying periods of time.

The cleaning fluid can additionally be expelled over a pressure medium from the barrel interior 21, by connecting the pusher interior 9 to a pressure source at intermediate times. The spray openings 3 offer for the filling process of a barrel, even altogether, too small a cross section. On the other hand, the cross section of the spray openings 3 must be relatively small, so that the desired spraying effect is achieved. It is provided according to the invention, therefore, that the valve body 5 can be pressed out of the first opening position with the aid of the axially adjustable sleeve 13 into the second opening position situated further above. In this second opening position the sealing segments 23 have also freed the filling openings 12. The beverage fluid is supplied over the pusher exterior 11. There the gas present in the barrel interior 21 can escape over the riser tube 15 and the passage openings 29 into the pusher interior space 9. On completion of the filling operation the barrel is lifted from the treatment head. The valve body 5 returns immediately into its starting closed position. The barrel is again completely closed. For the connection of the appliance to a tapping appliance the casing head 34 has a correspondingly dimensioned and formed hollow space 24, which also presents the corresponding oblique ribs 37 for the tightening of the tapping appliance. The tapping appliance likewise has a sleeve corresponding to the inner sleeve 13 and a sleeve corresponding to the outer sleeve 14. In the tapping, the valve body 5 is pressed from the inner sleeve into the second opening position. When the appliance is directed downward, then pressure gas is supplied over the pusher interior space 9, while the beverage fluid is dispensed over the pusher exterior space 11. If, however, the appliance is on the upper side of the barrel, then the feed of the pressure gas occurs over the pusher exterior space 11 and the beverage fluid is pressed over the riser tube 15 into the pusher interior 9.

Figure 2A:
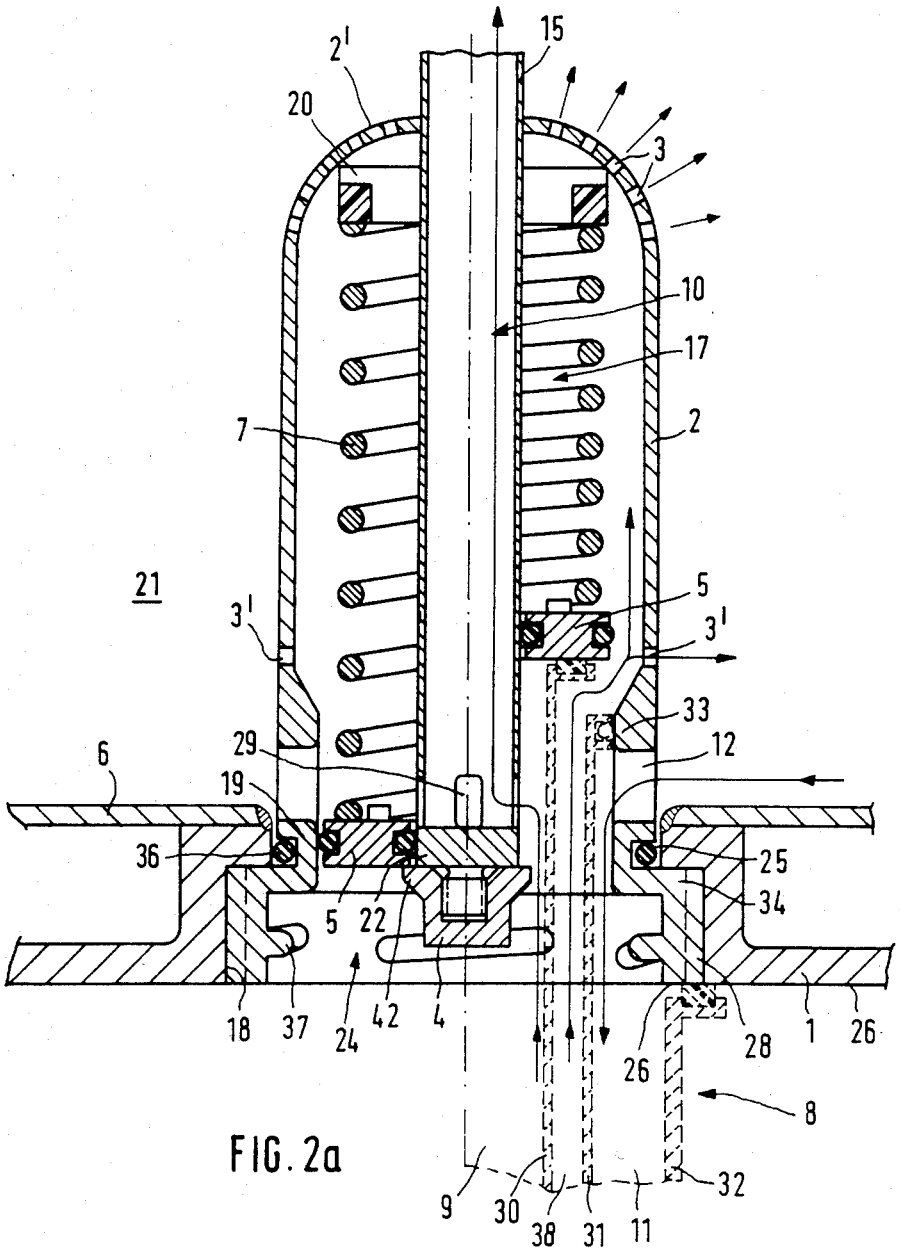
Figure 2B:
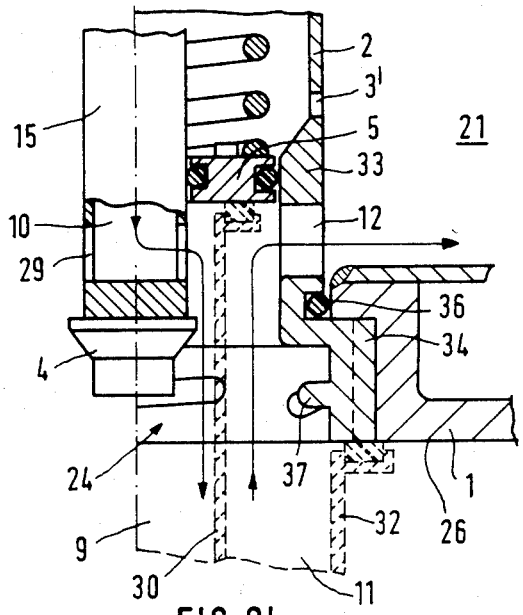

The form of execution of the appliance according to FIGS. 2*a* and 2*b* is distinguished from the first described embodiment essentially in that the valve body 5 has substantially a simple annular form with outer and inner sealing rings, which in the starting closed position lie on the first tight seat 19 of the casing 2 and the second tight seat 22 of the riser tube 15. The casing head 34 is, to be sure, again connected over thread connection 28 with the bung plate 1. The sealing off against the bung plate occurs in this case, however, with the aid of a radial seal 36 arranged in a circumferential groove 25. The casing 2 is constructed in one piece with the cap section 2'. At the lower end of the riser tube 15 connected with the cap section 2' there is present a nut 4 with self-inhibiting conical engagement surface for a tool. With the aid of this nut 4 the casing, inclusive of riser tube 15, valve body 5 and spring 7, can be turned into the bung plate. The nut 4 extends radially beyond the riser tube cross section and thus forms an outer stop ledge 42 for the valve body 5. The casing 2 has in this represented case no lower spray openings 3. Rather, the filling openings 12 are directly bordering on the inner surface of the barrel wall 6. They serve, accordingly, also as reflux openings. Directly over the filling openings 12 distributed over the circumference of the casing 2 there is formed a third tight seat 33 on the casing 2. On the third tight seat 33—while the valve body 5 is in a far thrust-in first opening position according to FIG. 2*a*—a middle sleeve 31 of a pusher device 8 consisting in this case of three concentric sleeves 30, 31 and 32, lies with sealing effect. It is perceived from FIG. 2*a* that thereby three separate flow paths are formed, namely, an inner flow path from the pusher interior space 9 over the passage openings 29 into the interior 10 of the riser tube, a middle outer flow path from the annular pusher interspace 38 into the casing interior 17 and to the spray openings 3 into the cap section 2', as well as a further outer flow path from the pusher exterior space 11 over the filling openings 12 into the barrel interior 21. The arrow representation in FIG. 2*a* illustrates the cleaning process. Cleaning fluid is sprayed over the innermost and the middle flow path, flowing through the riser tube 15 and the spray openings 3 onto the inner surfaces of the barrel wall 6, for example in pulsations, while the used cleaning fluid can flow off over the filling openings 12 into the pusher exterior space 11. According to FIG. 2*b* the middle sleeve 31 is in retracted position and the valve body 5 is in a second opening position in sealing engagement on the third tight seat 33 of the casing 2. This is the position of the appliance in the filling process. The cleaning fluid passes from the pusher exterior space 11 over the filling openings 12 of adequately large cross section into the barrel interior space 21, while the gas from the barrel interior space 21 can escape over the riser tube 15, the passage openings 29 and the pusher interior space 9. The tapping of the beverage fluid occurs in the same position of the appliance with reversed direction of flow of the medium.

Figure 3:
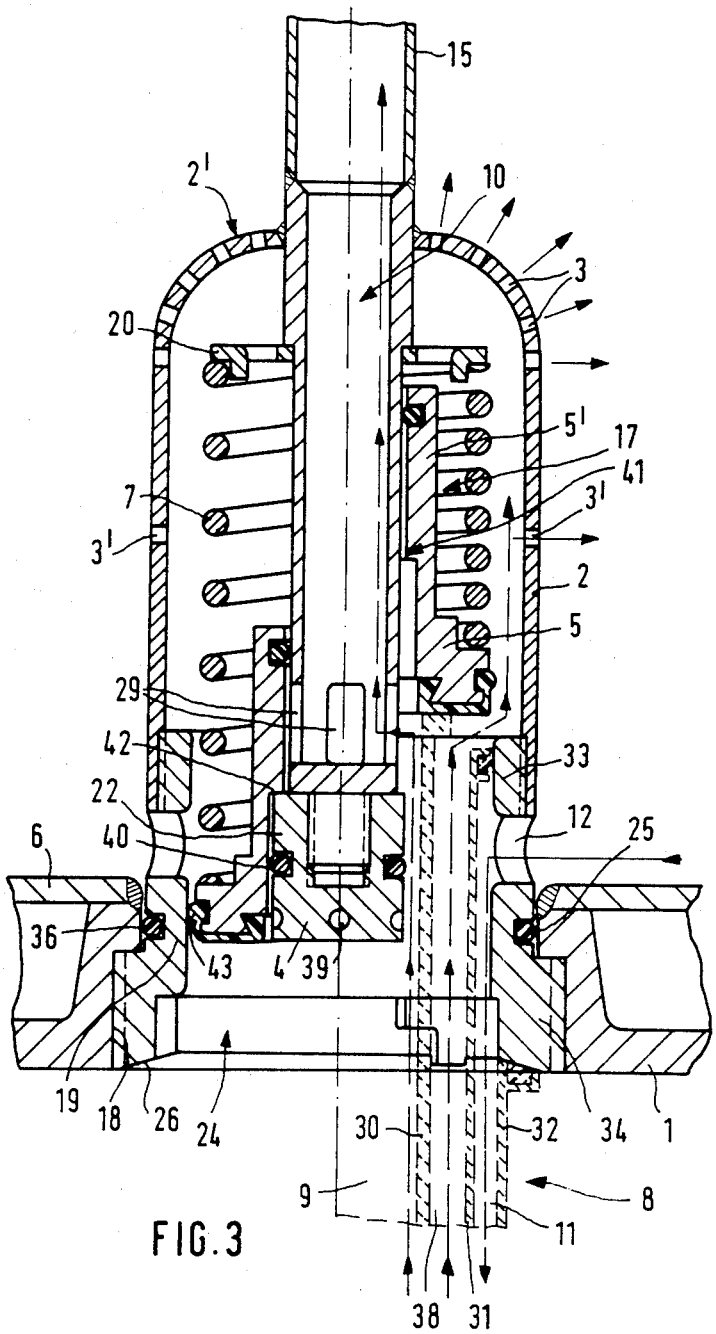
FIG. 3 shows a third form of execution of the thought of the invention.

The form of execution of the thought of the invention illustrated in FIG. 3 is comparable with that in FIG. 2*a*. It differs from the preceding essentially in the following points: The face surface 26 of the casing head 34 screwed into the bung plate 1 is inclined obliquely inward for the sealing engagement of the sleeve 32. The nut 4 at the lower end of the riser tube 15 has engagement openings 39 and forms with a sealing ring 40 of its own a tight seat 22 for the valve body 5. The valve body itself has an upward extending sleeve-form added piece 5' for the guidance on the riser tube. The added piece 5' forms a counter-ledge 41 for the stop shoulder 42 of the nut 4. The valve body 5 carries an outer annular seal 43 for the engagement on the outer tight seat 19, the seal 43 being drawn on face side over the valve body in order to promote a sealing face-side engagement of the sleeve 30.

Figure 4:
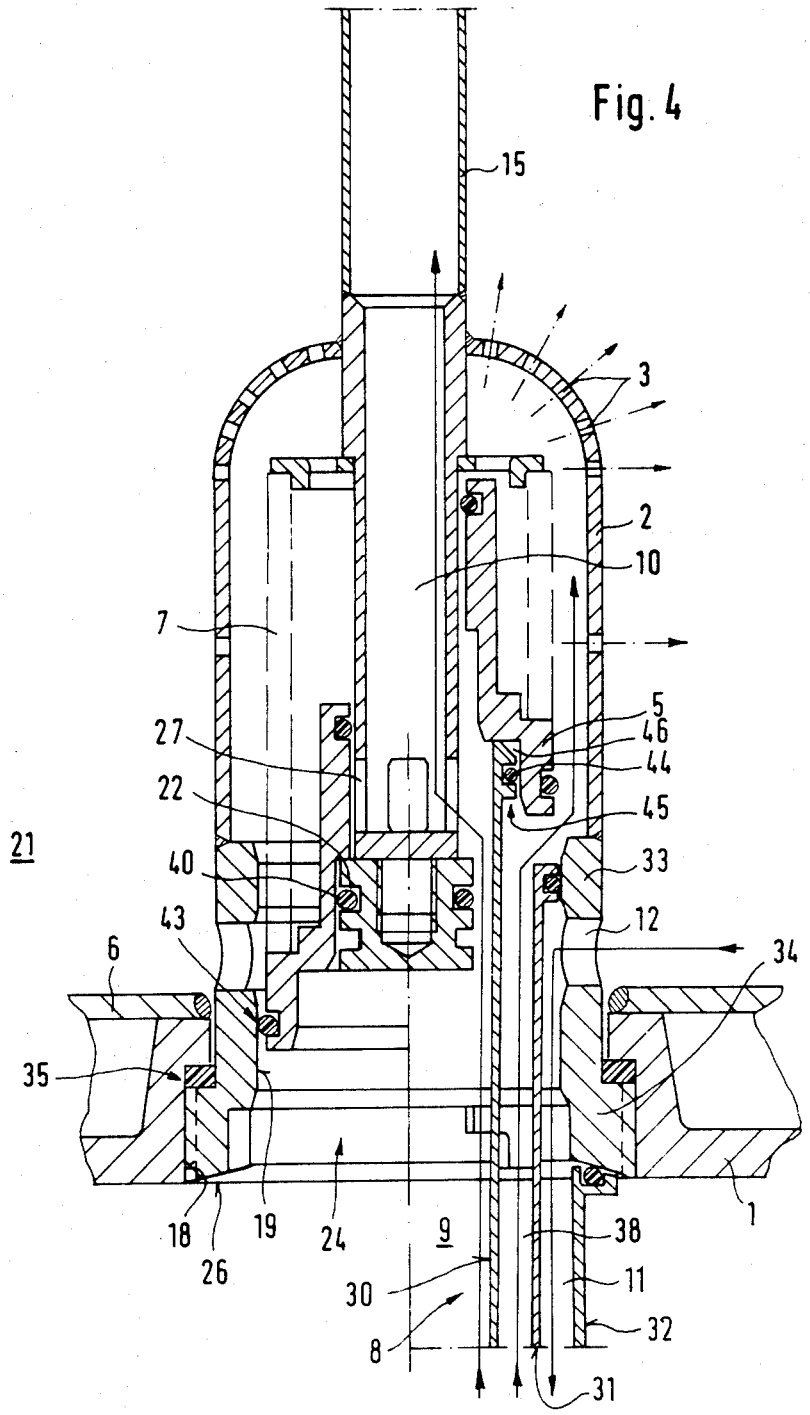
FIG. 4 shows a section through an appliance corresponding to a form of execution according to FIG. *2a* of the main application with three sleeves of the pusher device.

In respect to the general structure and functioning of the appliances according to the invention of FIGS. 4 and 5, reference is first made to the full content of the above description. In the following there will be explained in detail essentially the features in which the forms of execution of FIGS. 4 and 5 are distinguished from the forms of execution described in connection with FIGS. 1 to 3. In supplementation reference is made to the list of reference symbols provided at the close of the specification.

The appliance according to FIG. 4 cooperates with three sleeves 30, 31 and 32 of a pusher device of the treatment head or of a tapping applicance, axially feedable and preferably slidable axially to one another. On the left half of the graphic representation there is present the valve body 5 in closed position. The right half of the drawing illustrates the valve body 5 in the first opening position, which the valve body 5 occupies by reason of interaction with the pusher device 8 in the cleaning process. Over the central channel formed by the pusher interior space 9 of the innermost sleeve 30 cleaning fluid is conducted over the passage openings 29 into the riser tube interior space 10 and sprayed from the opening (not represented) of the riser tube 15 onto the oppositely lying wall inner surface. The front end of the innermost sleeve 30 has in this position pushed back the valve body 5 against the action of the spring 7 so far that the outer sealing ring 43 is lifted off both from the first tight seat 19 on the casing head 34 and also axially conducted past axially the third tight seat 33 of the casing 2. With the front end the innermost sleeve 30 engages there into a cylindrical recess 45 of the valve body 5 and lies with an annular outer seal 44 radially on the sealing counter-surface 46 of the valve body 5. On face side the valve body 5 abuts on the face surface of the sleeve 30. Through this form of execution there is prevented a tilting of the valve body 5 in the sliding movement on the riser tube 15. In the first opening position of the valve body 5 represented in FIG. 4 (right half) the middle sleeve 31 of the pusher device 8 is slid into the casing 2 so far that this lies with its front sealing section radially on the third tight seat 33 of the casing 2. In this manner a pusher interspace 38 between the innermost sleeve 30 and the middle sleeve 31 is partitioned, through which the cleaning fluid can be fed into the casing 2 and through the spray openings 3 of comparatively small cross section independently of the cleaning fluid of the pusher interior space 9. The outermost sleeve 32 of the pusher device 8 lies face-side with sealing effect on the face surface 26 of the casing head 34. Through the thereby partitioned pusher outer space 11 between middle sleeve 31 and outer sleeve 32 of the pusher device 8 the (used) cleaning fluid collecting below in the barrel interior 21 can flow off. For the case of the filling of the barrel with beverage fluid, with respect to the first opening position the sleeve 30 is driven back axially so far that the valve body 5 interacts with its outer sealing ring with the third tight seat 33 on the casing 2. The middle sleeve 31 is drawn completely out of the casing 2. The beverage fluid can be fed through the common pusher space 11, 38 between innermost sleeve 30 and outermost sleeve 32 to the comparatively large filling openings 12. The tensioning gas present in the barrel interior 21 can escape over the riser tube inner space 10, the passage openings 29 and the pusher inner space 9, since the valve body 5 does not yet interact with the second tight seat 22 formed on the riser tube 15 in the second opening position. The tapping of the barrel occurs in the same second opening position of the valve body 5 and with completely withdrawn or lacking middle sleeve 31 and possibly stationary arrangement of the two other sleeves 30, 32. Depending on whether in the tapping the appliance is on the upper side or on the under-side of the barrel, as described in the main application, the pressure gas is pressed through the pusher interior 9 or the pusher inner space 11, 38 into the barrel interior 21, while in each case the other flow path is available for the beverage fluid to be dispensed.

Figure 5A:
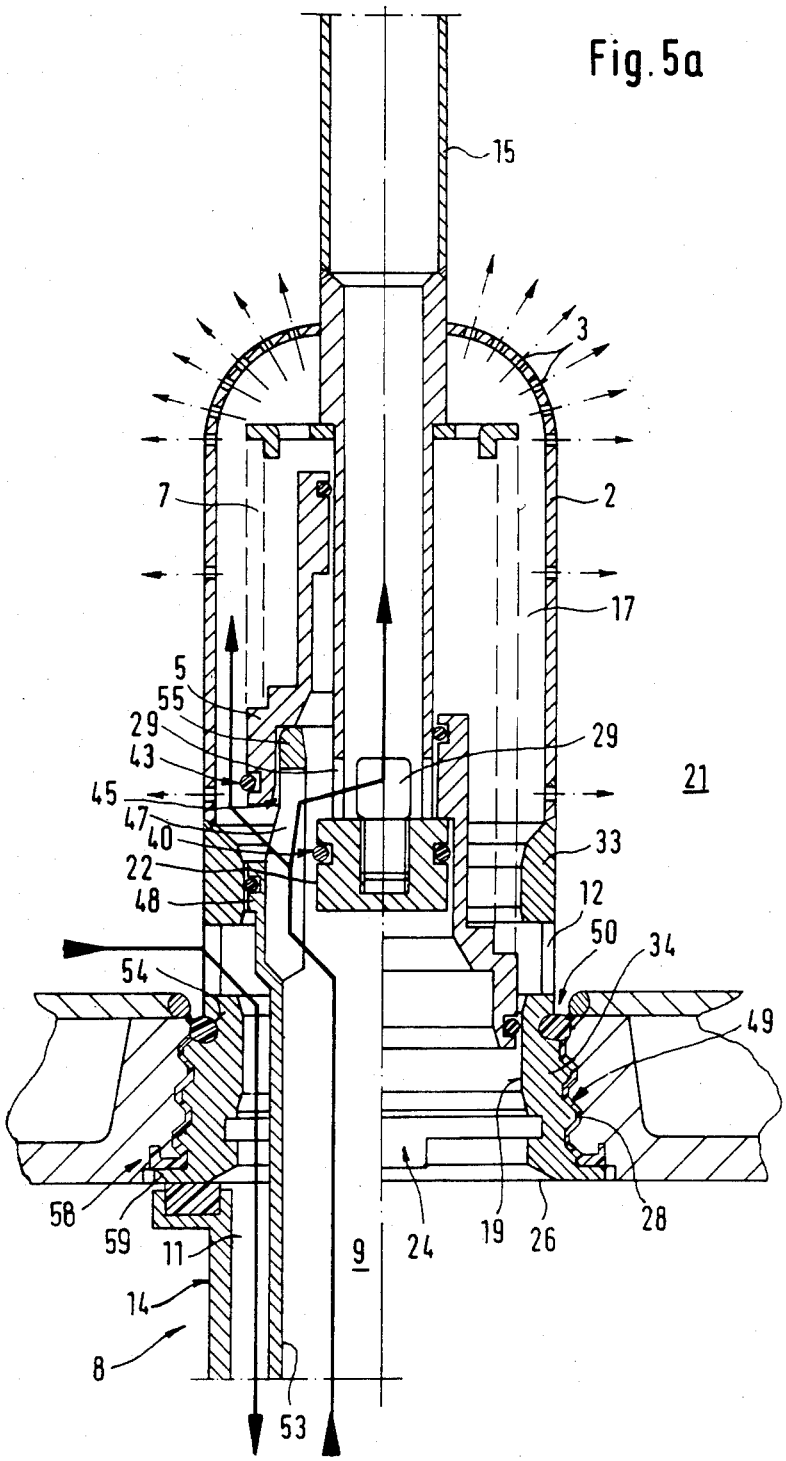

In the appliance according to FIG. 5*a* the pusher device 8 of a treatment head consists of two axially shiftable sleeves 14 and 53, shiftable axially to one another. The inner sleeve 53 encloses the pusher interior space 9. Between the outer sleeve 14 and the inner sleeve 53 there is formed an annular pusher outer space 11. While the outer sleeve 14 lies face-side with sealing effect on the face surface 26 of the casing head 34, in the first opening position represented in the left half of the drawing, the inner sleeve 53 has pushed the valve body 5 out of the closing position represented in the right half of the drawing so far axially against the action of the spring 7 into the casing 2, that the outer sealing ring 43 has axially run over also the third tight seat 33 on the casing 2. With the front extension 55 the inner sleeve 53 is seated there in a cylindrical recess 45 of the valve body 5 for its guidance. In the extension 55 above the sealing section 48 interacting with the third tight seat 33 with radial sealing effect there are left passage openings 47 into the casing interior 17. Since the valve body 5 in this first opening position is also lifted off from the second tight seat 22 on the riser tube 15, also the passage openings 29 to the pusher tube interior space 10 lie free. From the pusher interior space 9, therefore there can be fed to the spray openings 3 of comparatively small cross section and the riser tube 10 and thereby its upper spray opening a common cleaning fluid stream. A sealing off of the inner sleeve 53 against the valve body 5 is not required in this case. Since the inner sleeve lies with the sealing section 48 on the third tight seat 33 of the casing 2, over the comparatively large filling openings 12 and the pusher exterior space 11 partitioned between the sleeves 14 and 53 there is created the possibility for the flow-off of the (used) cleaning fluid from the barrel interior. In the return of the valve body 5 into the second opening position, if the tight seat 33 is constructed correspondingly long, also the seal 43 of the valve body 5 passes into engagement on the third tight seat 33 of the casing 2, while the sealing section 48 still lies on it. The casing interior space 17 would thereby be closed off underneath for the filling of the beverage fluid over the pusher outer space 11 and the filling openings 12. The tensioning gas could, in the filling of the beverage fluid, again escape over the riser tube 15 and the pusher interior 9. For the filling and tapping there could be used the same pusher device as in the cleaning.

Figure 5B:
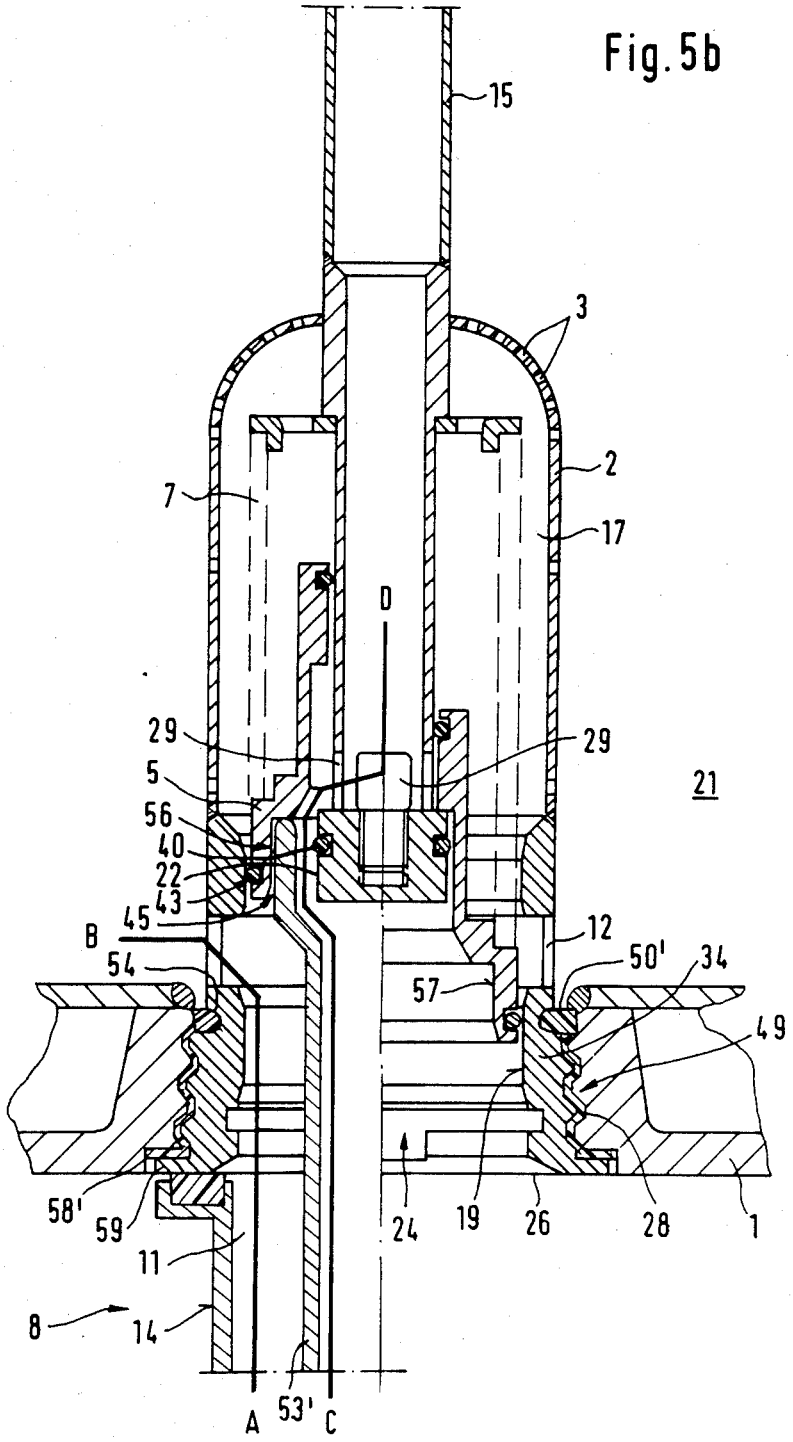

Preferably, however, according to FIG. 5*b* in the filling and tapping there is used a pusher device with an inner continuous sleeve 53', which extends into the cylindrical recess 45 of the valve body 5 and lies there with an outer seal 56 on a sealing counter-surface 57 of the valve body 5. In the second opening position of the valve body 5 represented in the left half of the drawing of FIG. 5*b*, in the filling, for example, beer flows from A to B and tensioning gas from D toward C in separate channels, and in the tapping (with appliance turned upward), for example, beer flows from D toward C and pressure gas from A toward B. In the execution according to FIG. 5*b* the plastic layer 49 is formed as a homogeneous collar with axially inner sealing bulge 50' and flat engaging collet 58'.

The form of execution according to FIGS. 5*a* and 5*b* is distinguished also by a special fixing of the casing head 34 in the bung plate 1. While according to the execution forms of hitherto in the bung plate a special thread was provided, in the form of execution according to FIGS. 5*a* and 5*b* there is utilized the conical thread ordinarily already present in barrels on hand. The thread connection 28 between casing head 34 and bung plate 1 is established by interlay of a plastic layer 49. This consists in the case represented of a plastic collar or lining which extends to shortly in front of a sealing ring 50 lying axially inside in a corresponding circumferential groove 54 of the casing head, and has at the outer end a bent-off supporting collar 58, against which there comes to lie a corresponding collar 59 of the casing head 34, until the face surface of the casing head 34 aligns with the outer surface of the bung plate 1. In the screwing-in of the thread head 34 a correspondingly thin-walled plastic collar takes on the form of the thread courses. Thereby there occurs a sure sealing off of the casing head 34 against the bung plate 1 and a sure insulation of the metallic materials of the casing head 34 and bung plate 1 from one another.

Figure 6A:
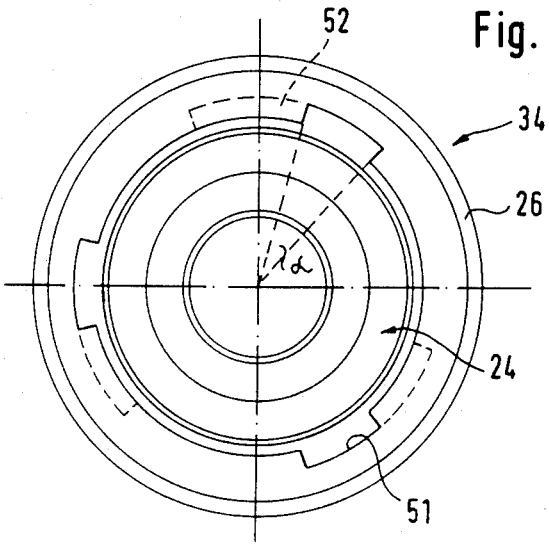
Figure 6B:
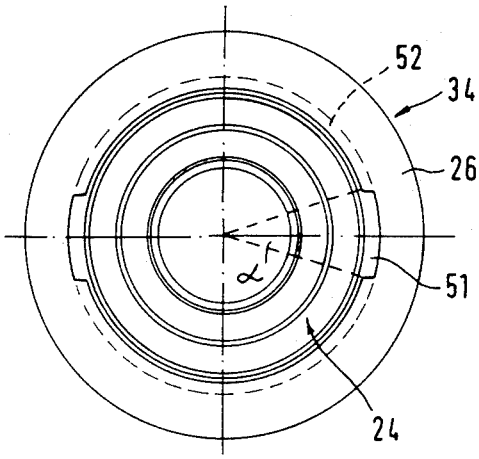

FIGS. 6*a* and 6*b* show in plan view special forms of execution of a casing head 34 according to the invention, and, namely, in respect to the bayonet lock elements provided on it. In the casing 34 according to FIG. 6*a* there are three free spaces 51 arranged at an angular spacing of 120°, facing the casing head hollow space 24, running in circumferential direction, for the passage of corresponding bayonet cams on a treatment head or a tapping appliance, upon which there follow underneath the adjacent edges grooves with guide surfaces 52 for the bayonet cams. The special feature of the free spaces 51 is their short circumferential extent. They correspond to a center angle of $\alpha$, in which the sum of all the center angles of the free spaces 51 is at any rate smaller than 180°. Thereby there is avoided any damage to the casing head 34, which is also usable for face-side application in cylindrical barrels, such as kegs, even in the belly-side use in barrels, which, according to experience, are frequently transported by rolling. The requisite bayonet cams of correspondingly small circumferential dimension are located according to this inventive though, contrary to proposals of hitherto, on the treatment head or the tapping appliance. FIG. 6*b* illustrates a corresponding formation of a casing head 34, but with two instead of three free spaces 51. There is correspondingly reduced, of course, also the number of bayonet cams on the treatment head or the tapping appliance. It is a matter, therefore, in this case, too, of a casing head 34 which can be used both on face side in kegs and also on belly-side in barrels, so that for both barrel systems there can be used the same treatment-head and tapping appliance.

List of Reference Numbers

1. Bung plate
2. Casing
2'. Cap section
3. Spray openings
4. Nut
5. Valve body
5'. Added piece
6. Barrel mantle
7. Spring
8. Pusher device
9. Pusher interior
10. Riser tube interior
11. Pusher exterior space
12. Filling openings
13. Inner sleeves
14. Outer sleeves
15. Riser tube
16. Bayonet lock
17. Casing inner space
18. Bung opening
19. First tight seat
20. Counter-bearing
21. Barrel interior
22. Second tight seat
23. Sealing segments
24. Hollow space
25. Circumferential groove
26. Face surface
27. Wall zone
28. Thread connection/joint
29. Passage openings
30. Sleeve
31. Sleeve
32. Sleeve
33. Third tight seat
34. Casing head
35. Sealing ring
36. Sealing ring
37. Ribs
38. Pusher interspace
39. Engagement openings
40. Sealing ring
41. Counter-ledge
42. Stop ledge
43. Sealing ring
44. Outer seal
45. Recess
46. Sealing counter-surface
47. Passage opening
48. Sealing section
49. Plastic layer
50. Sealing ring
50'. Sealing bulge
51. Free spaces
52. Guide surfaces
53. Sleeve
53'. Sleeve
54. Circumferential groove
55. Extension
56. Outer seal
57. Sealing counter-surface
58. Engaging collar
58'. Engaging collar

What is claimed is:

1. In a process for cleaning a barrel provided with a bung opening in a mantle of the barrel by using an appliance for cleaning, filling and/or tapping, wherein cleaning fluid is fed into an interior of the barrel at least through a riser tube of the appliance, and where the cleaning fluid can flow off from the interior of the barrel through filling openings which are provided in the appliance in the vicinity of the barrel mantle, an improvement comprising:

also feeding cleaning fluid into the interior of the barrel through spray openings provided in a casing of the appliance when a valve body of the appliance is in a selected first opening position; and directing the cleaning fluid from the spray openings towards inner surfaces of the barrel walls, whereby the spray openings are pointed in the direction of the inner surfaces of the barrel walls.

2. In a process according to claim 1, including feeding the cleaning fluid during alternating periods of time predominantly to an outer flow passage of the appliance, therefore to the spray openings, and to an inner flow passage of the appliance, therefore to the riser tube.

3. In a process according to claim 1, including feeding the cleaning fluid to the interior of the barrel in pulsations.

4. In a process according to claim 1, including expelling the cleaning fluid collected in the interior of the barrel by action of gas pressure fed into an inner flow passage of the appliance and into the riser tube.

5. In a process according to claim 1, including also feeding the cleaning fluid to an inner flow passage of the appliance, therefore to the riser tube, during periods of time in which the cleaning fluid is being fed to an outer flow passage of the appliance, therefore to the spray openings.

* * * * *